US009316010B2

(12) United States Patent
Perrier et al.

(10) Patent No.: US 9,316,010 B2
(45) Date of Patent: Apr. 19, 2016

(54) SAFETY SWIMMING POOL APPARATUS

(71) Applicant: Cynthia Perrier, Dix Hills, NY (US)

(72) Inventors: Gregory Perrier, Dix Hills, NY (US); John Mizzi, Poughkeepsie, NY (US)

( * ) Notice: Subject to any disclaimer, the term of this patent is extended or adjusted under 35 U.S.C. 154(b) by 183 days.

(21) Appl. No.: 14/010,420

(22) Filed: Aug. 26, 2013

(65) Prior Publication Data

US 2014/0090164 A1 Apr. 3, 2014

Related U.S. Application Data

(62) Division of application No. 12/843,035, filed on Jul. 25, 2010, now abandoned.

(51) Int. Cl.
*E04H 4/00* (2006.01)
*E04H 4/06* (2006.01)

(52) U.S. Cl.
CPC ..... *E04H 4/065* (2013.01)

(58) Field of Classification Search
CPC ..... E04H 4/065
USPC ..... 4/501, 504; 307/64, 66, 326
See application file for complete search history.

(56) References Cited

U.S. PATENT DOCUMENTS

| | | | | | |
|---|---|---|---|---|---|
| 1,091,909 | A * | 3/1914 | Birmingham | 4/504 |
| 3,045,253 | A * | 7/1962 | Price | 4/504 |
| 3,482,237 | A * | 12/1969 | Fowler et al. | 340/566 |
| 3,668,711 | A * | 6/1972 | Liermann et al. | 4/501 |
| 4,106,134 | A * | 8/1978 | Schiron et al. | 4/495 |
| 4,333,094 | A * | 6/1982 | Osborne | 340/566 |
| 4,408,193 | A * | 10/1983 | Millen | 340/566 |
| 4,831,672 | A * | 5/1989 | Niimura | 4/495 |
| 5,267,358 | A * | 12/1993 | Roy et al. | 4/504 |
| 5,678,253 | A * | 10/1997 | Baker | 4/495 |
| 5,832,547 | A * | 11/1998 | Burroughs | 4/504 |
| 6,389,615 | B2 * | 5/2002 | Perrier | 4/495 |
| 6,493,885 | B2 * | 12/2002 | Perrier | 4/504 |
| 6,640,504 | B2 * | 11/2003 | Pearlson et al. | 52/66 |
| 6,676,831 | B2 * | 1/2004 | Wolfe | 210/85 |
| 2006/0220460 | A1 * | 10/2006 | Grolmes et al. | 307/30 |
| 2009/0153096 | A1 * | 6/2009 | Lin et al. | 320/101 |

* cited by examiner

*Primary Examiner* — Lauren Crane
*Assistant Examiner* — Erin Deery
(74) *Attorney, Agent, or Firm* — Alfred M. Walker; John F. Vodopia

(57) ABSTRACT

Apparatus usable with a safety swimming pool incorporating a buoyant submersed rescue floor is described. In one instance, a winch coupling a gear motor to a cable drum via an electrically disengageable clutch is used as a device to redeploy the buoyant floor to the bottom after a rescue. In another instance a solar powered dedicated power supply is used to power the trigger/sensor subsystem. In yet another instance an electro-mechanical circuit for sensing and triggering a rescue episode is described.

18 Claims, 7 Drawing Sheets

SAFETY SWIMMING POOL APPARATUS

RELATED APPLICATIONS

This application is a divisional of application Ser. No. 12/843,035, filed Jul. 25, 2010, and claims priority under 35 USC §120 therefrom. That application is incorporated by reference herein.

FIELD OF THE INVENTION

The present invention relates to safety devices to prevent drownings in swimming pools.

BACKGROUND OF THE INVENTION

This invention relates to new apparatus elements compatible with the basic concept of a buoyant rescue floor in a pool which rises to bring a person up and out of the water when an automatic or manual trigger switch is engaged to release it from the bottom. U.S. Pat. Nos. 6,389,615 and 6,493,885 of Gregory Perrier describe the basic concept as well as details of hydraulic or electro-mechanical actuators used to re-deploy the buoyant floor to the bottom (ie. to submerge it).

SUMMARY OF THE INVENTION

Although the Perrier '615 and '885 patents cited above do describe electro-mechanical means to accomplish the submerging function as a number of specialized motor-driven timing belt actuators dispersed around the pool periphery, no discussion of the application of a winch mechanism as an alternative was discussed. This invention describes the use of winches with electrically disengagable clutches between the motor and cable winding drum. Upon command, the drum is disengaged from the motor to permit the buoyant floor to rise freely in an emergency. All such clutches (one for each of the winches used) would be simultaneously disengaged. Until the clutch is disengaged, the cable is under tension holding the floor down through a direction reversing pulley near the pool bottom. The motor/gear friction prevents backwinding by floor tension; incorporation of at least one stage of worm gear drive is one way to ensure this function. Only uni-directional motor drive is required for inexpensive AC induction motor use. Note that since only slow submersion is required, low power actuators such as this winch mechanism, can be used even though the submerged rescue floor stores significant potential energy for rapid release upon triggering. Since the winch described here uses many similar components from ordinary winches which are available in large volume, it will be less expensive to implement than an equivalent timing belt actuator described in the cited prior art (see FIGS. 7 and 8 of Perrier U.S. Pat. Nos. 6,389,615 and 6,493,885). For a very small pool, a single hand cranked winch (no motor required) with electrically disengageable clutch can be used to redeploy the buoyant floor with a centrally attached cable; a miniature demonstration model of this design has been built.

A solar-powered power supply with storage battery and AC back-up is also described to supply power to the sensor/trigger system to deploy the rescue floor in an emergency. The prior art had called for an uninterruptible power supply (UPS) which would back up the AC (or other power equivalent outside of the United States) during a short power failure. Recent experience with the use of solar panels to power parking kiosks, road hazard signs, and parking lot and road lighting has proven the reliability of these systems. Since this is a potential life and death application, an additional AC back-up for the storage battery/ solar panel subsystem is included. The only remaining exposure is gross component failure or the simultaneous AC power outage with solar/battery failure.

A low cost circuit for an electro-mechanical sensor/trigger circuit is described. Although sophisticated pool sensors using acoustic and optical techniques exist, a simple floating tilt sensor (such as a ball-in-cage or mercury switch) may be more reliable. This can be used alone or in conjunction with a manual direct or remote control trigger switch circuit.

Optionally the trigger switch circuit can alert emergency rescue telephone number 911, which has an automatic address (if from a land line call) or uses cell GPS for location, where location coordinates are calculated from GPS signals received by a GPS chip set. Therefore an emergency response team can be sent to the address of the swimming pool having an emergency rescue situation requiring medical attention.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THIS INVENTION

Figure 1:
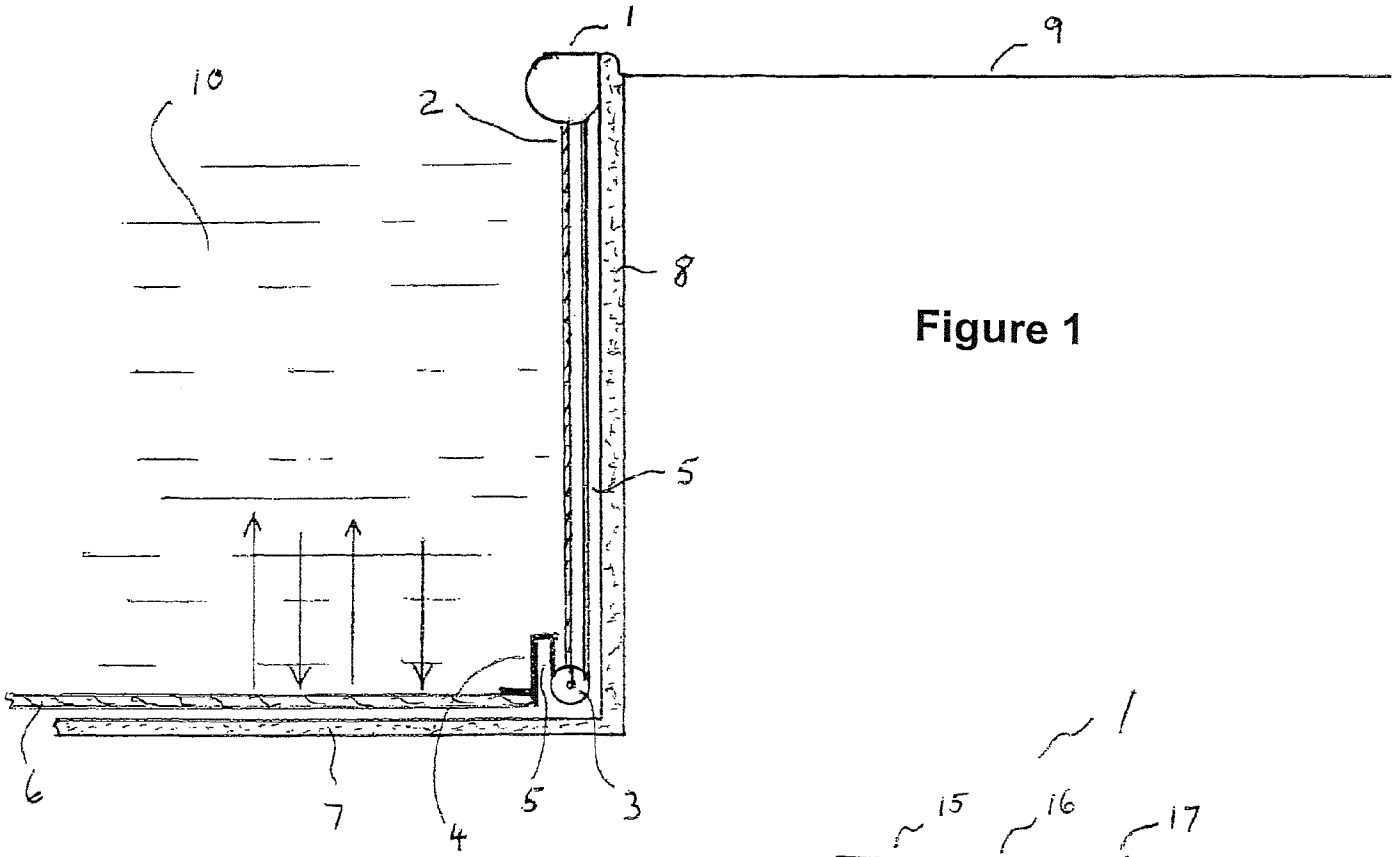
FIG. 1 is a side elevation in partial crossection of a pool section with a winch of this invention used as a buoyant rescue floor submersion mechanism.
Figure 2:
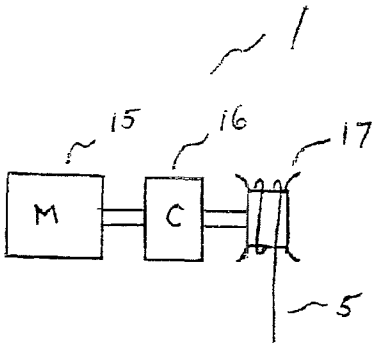
FIG. 2 is a side view of the major winch components.
Figure 1A:
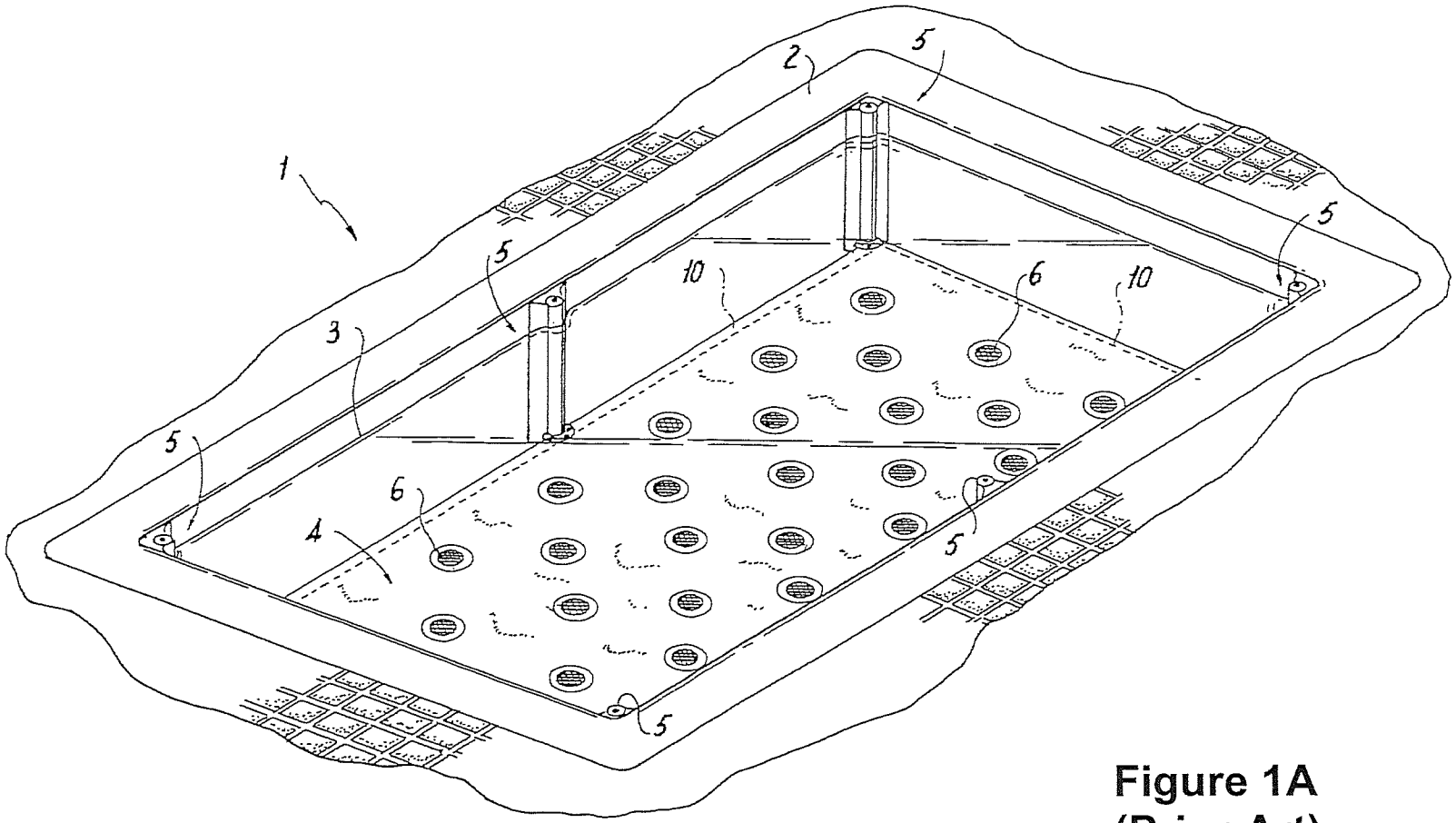
Figure 1A (Prior Art)
FIG. 1A is a perspective view of a swimming pool with a prior art submerged buoyant swimming pool safety net.
Figure 1B:
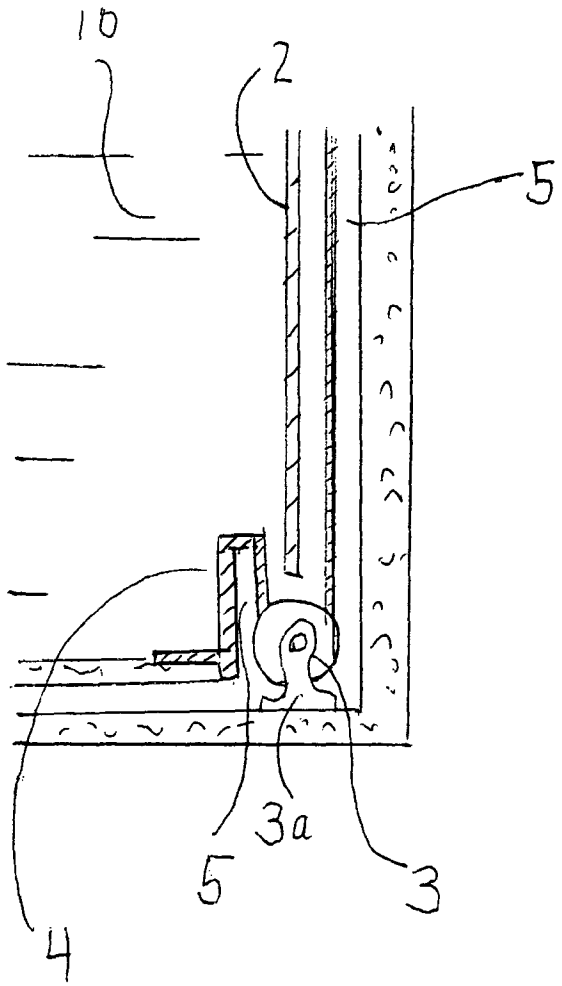
FIG. 1B is a close-up detail view of the lower winch pulley attaching region of the pool section shown in FIG. 1, showing the winch pulley attached to the pool bottom.
Figure 1C:
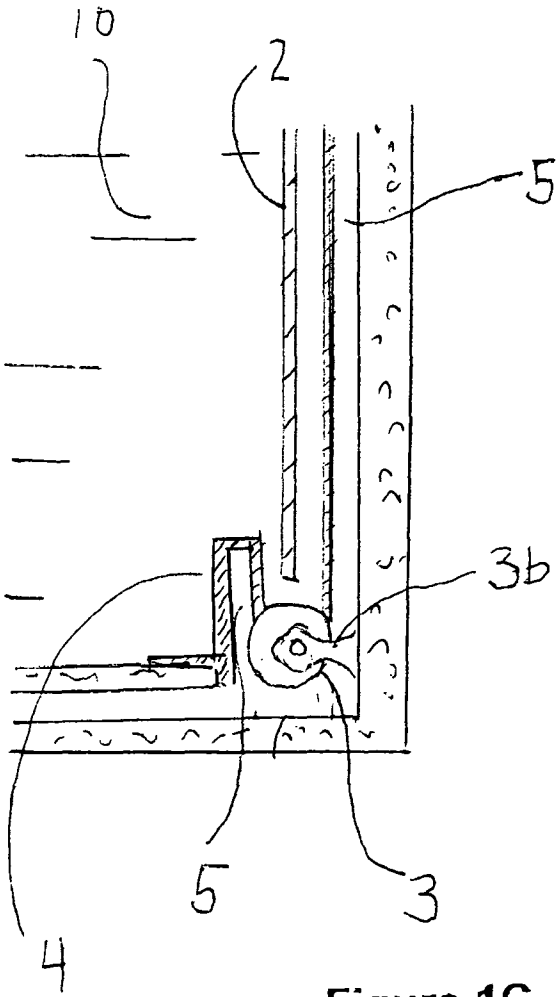
FIG. 1C is a close-up detail view of the lower winch pulley attaching region of the pool section shown in FIG. 1, showing the winch pulley attached to the bottom of the vertical wall, near the pool bottom.
Figure 1D:
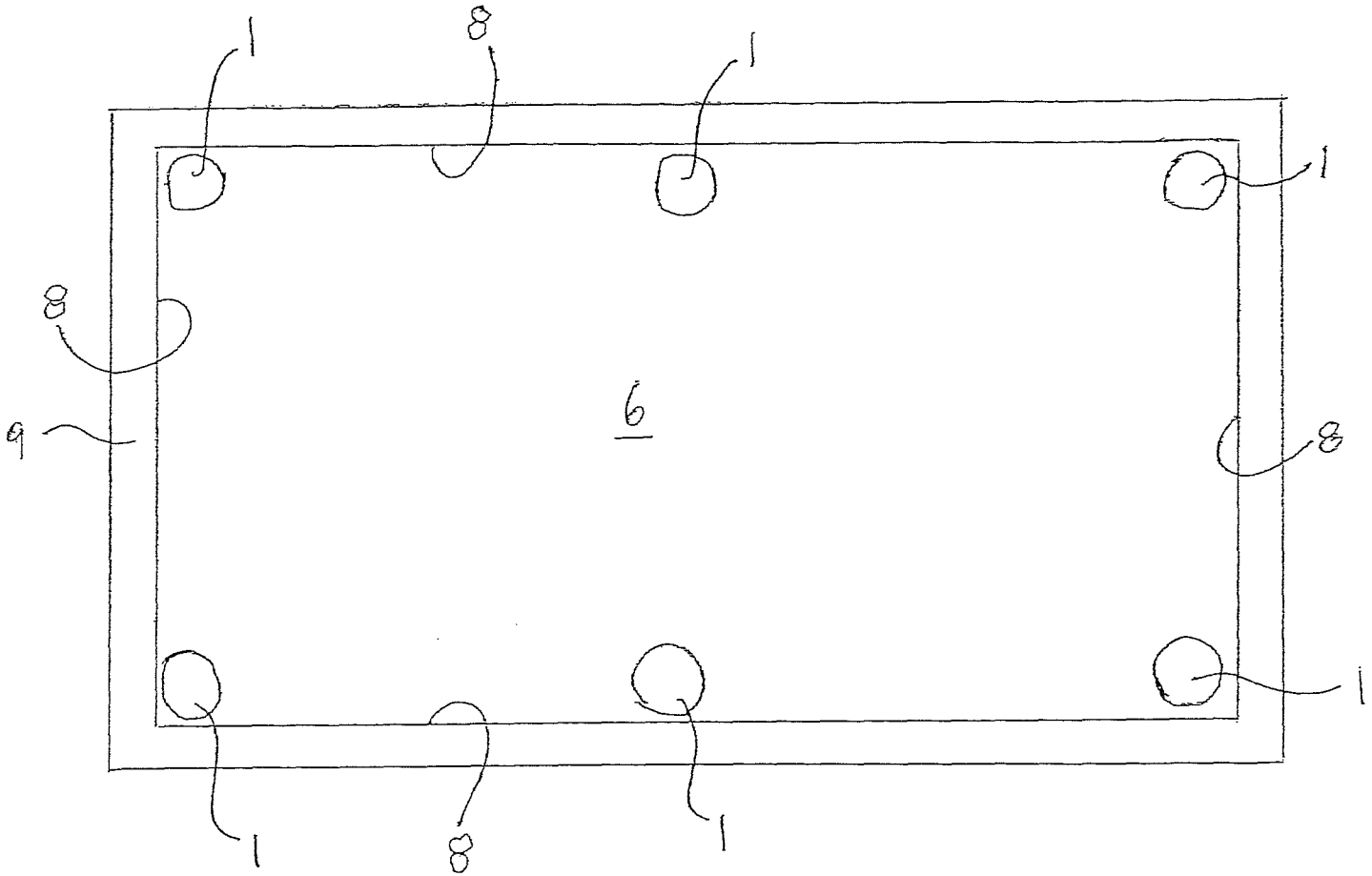
FIG. 1D is a top plan view of a plurality of low power winches deployed around a periphery of a swimming pool for lowering a pool rescue floor down to a bottom of a pool.
Figure 2A:
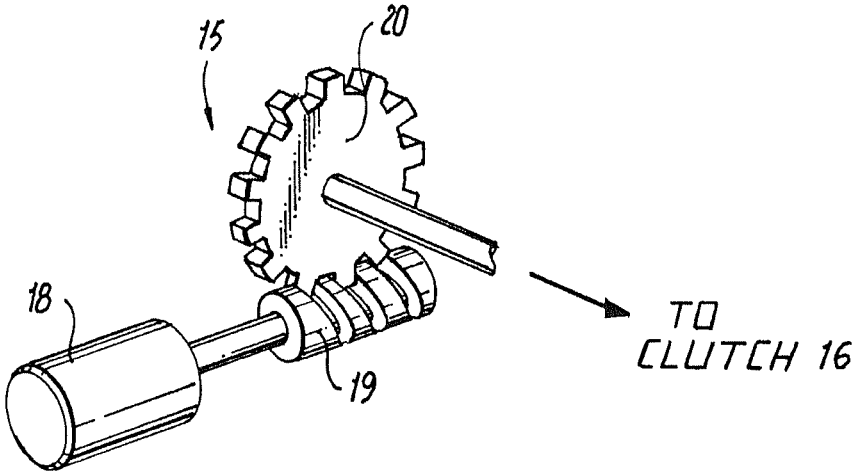
FIG. 2A shows a perspective view of a motor with a worn gear drive.
Figure 2B:
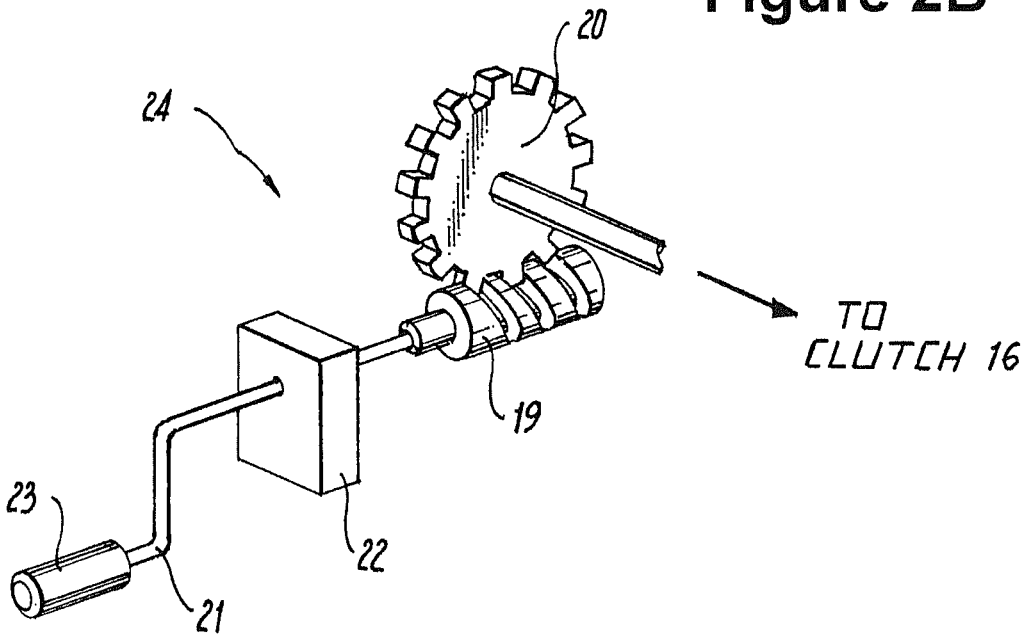
FIG. 2B shows a perspective view of a hand crank with a worm gear drive.

A winch can be used as an actuator to submerge a portion of the buoyant rescue floor. FIG. 1 shows winch 1 attached to the inside top edge pool edge above the water line as a compact pod. A structural or safety down tube 2 encloses the cable 5 and isolates it from contact with swimmers. If no penetrations to the pool liner wall 8 or bottom 7 (below the water line) are desired, bottom pulley 3 is then attached to down tube 2 (as shown) which must have structural integrity. Alternatively, as shown in FIG. 1B, pulley 3 can be attached to the pool bottom 7 with attachment bracket 3*a*, or, as shown in FIG. 1C, to vertical wall 8 near the bottom with attachment bracket 3*b*. Cable 5 loops around and attaches to bracket 4 which is attached to rescue floor 6. Other features shown are pool deck level 9 and pool water 10. FIG. 1D shows a plurality of low power winches 1 dispersed around a periphery of the swimming pool walls 8 adjacent to pool deck 9 for deploying buoyant rescue floor 6 down to pool bottom 7, shown in FIG. 1. FIG. 2 shows the three main components of winch 1. Gear motor 15 (or hand winch with worm gear drive) is coupled to an electrically releasable clutch 16 which is attached to cable drum 17. FIG. 2A shows gear motor 15 of FIG. 2, showing motor 18 driving worm pinion 19 with output gear 20. FIG. 2B shows a hand crank substitute 24 for gear motor 15 of FIG. 2. Hand crank 21 with handle 23 drives worm pinion 19 with output gear 20. Bearing block 22 supports the shaft of crank 21. Cable drum 17 can be released during an emergency to de-couple from motor 15 and turn freely while rescue floor 6 rises. Clutch 16 can be manually reset or electrically reset depending on type used. Both dog clutches and wrap-spring clutches are available in either design. In any case the resetting is not performed during an emergency phase.

Figure 3:
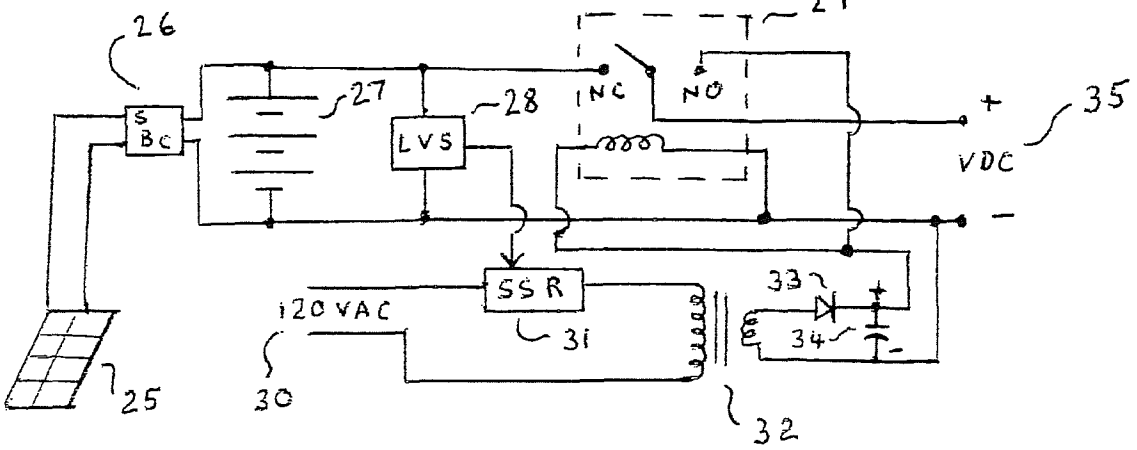
FIG. 3 is a circuit diagram of the solar power supply for the sensor/trigger subsystem.

A solar power supply for the sensor/trigger subsystem is shown in FIG. 3. Here, even if the pool is not in an area supplied with AC mains, the solar charged battery section can function without the AC back-up portion. However, in most cases the AC connection is available as it will probably be required (except for very small pools as described) for the re-deployment of the rescue floor to the bottom.

Solar panel 25 is used to charge battery 27 through a solar battery charger 26 designed to safely keep it at an optimal state of charge for long reliable operation. Without the desire for AC back-up of the solar portion, it can function to supply a low DC voltage (12-24 volts as designed) which, by virtue of the storage battery, can supply short bursts of relatively high current to supply the needs of solenoids which may be used in the trigger circuits. Only components 25-27 would be needed.

To improve the reliability and overcome battery or solar panel malfunctions, the rest of the circuit is used to provide AC back-up. The AC input 30 can be the typical 120 or higher AC mains voltage locally available (or other power equivalent outside of the United States). A directly wired supply is recommended. Solid state relay 31 is normally off, but it will be triggered on by low-voltage sensor 28 (denoting a problem with the solar supply). When triggered on, step-down transformer 32 is powered supplying low voltage AC to diode 33 and filter capacitor 34 creating an alternate source of low voltage DC which turns on relay 29 with a single-pole-double-throw contact arrangement, thereby substituting the AC supplied DC voltage at output 35 for the normally solar supplied voltage and current.

Figure 4:
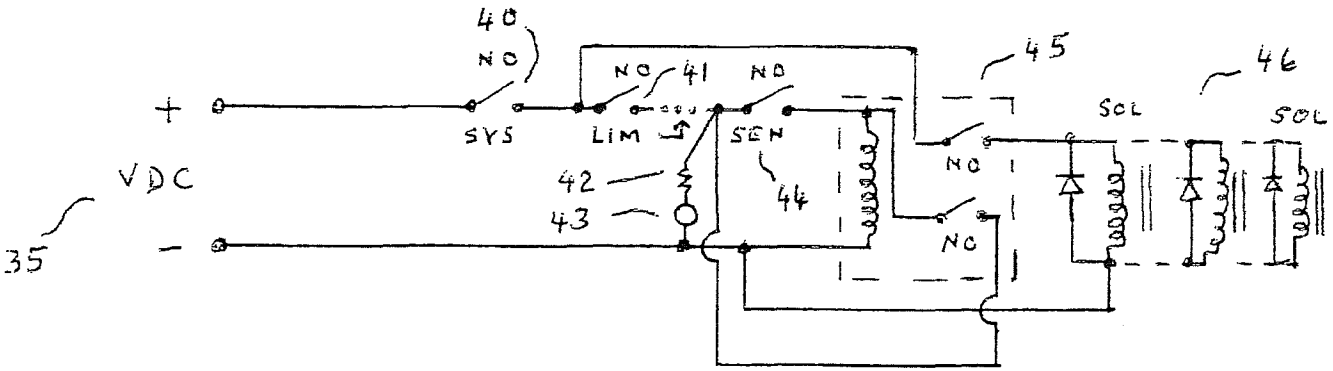
FIG. 4 is an electro-mechanical sensor/trigger circuit diagram of this invention.

FIG. 4 shows a circuit for a low-cost sensor/trigger to deploy the rescue floor upward. The input voltage is 12-24 volts DC as compatible with the components used (or other power equivalent outside of the United States). System switch 40 (which may be a key switch) enables the system when on. Next, the flow (using a set of dots) shows a series connection of all of the limit switches 41 (one for each re-deployment actuator) which detect if each actuator has reached its bottom floor limit. This can be implemented in a variety of ways by attachments to the cable or by cable tension or by submersed waterproof limit switches. At this point, if switch 40 is ON, then status indicator LED 43 (through resistor 42) should be glowing unless one or more actuators have not reached their limit; if so, corrective action must be taken before the circuit is armed to detect an emergency or respond to a manually detected emergency. Sensor 44 is a momentary contact floating tilt switch which detects ripples on the water surface denoting a substantial entity entering the water. Alternatively or in addition, manual emergency switches can be wired in parallel with sensor 44. Relay 45 is used to latch the intermittent signal from sensor 44 into a solid signal via feedback contacts as shown. The main contact drives the parallel circuit of triggering solenoids 46 (each with a snubber diode). There is one solenoid for each actuator which releases a clutch for an electro-mechanical type actuator, or it releases a valve for each hydraulic actuator. In the case shown, the solenoids have manual resets.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

We claim:

1. An electrical subsystem for a swimming pool having a permanently buoyant safety rescue floor, releasable by a triggering sub-circuit, initiated by activation of a sensor sub-circuit, the electrical subsystem comprising:

said buoyant safety floor associated with one or more low power submerging actuators;

a solar power supply and a sensor/trigger circuit wherein said solar power supply has at least one photovoltaic solar panel, a solar battery charger, and a storage battery which is kept at an optimal state of charge;

said solar power supply supplying low voltage DC to said sensor/trigger circuit; said sensor/trigger circuit comprising a single-pole single-throw (SPST) system switch for on/off control of sensing/triggering function, a limit switch sub-circuit to detect if each of said one or more low power submerging actuators has reached its bottom floor limit in the swimming pool, a sensor sub-circuit to automatically detect a person or other substantial entity entering the pool water or to respond to one or more manually operated momentary SPST emergency switches being activated to signal a triggering sub-circuit to permit said buoyant rescue floor to rise if said sensor sub-circuit is activated;

wherein said solar power supply further comprises:

an AC back-up with an AC input of 120 or higher AC mains voltage locally available, wherein a solid state relay is normally OFF, but said solid state relay is triggered ON by a low-voltage sensor denoting a problem with said at least one photovoltaic solar panel, said storage battery, said solar battery charger, or with their interconnections;

wherein further, when said solid-state relay is triggered ON, a step-down transformer is powered, supplies low voltage AC to a diode and a filter capacitor circuit, creates an alternate source of low voltage DC energizing a relay with a single-pole-double-throw contact arrangement, which said contacts substitute said AC supplied low voltage DC at the same output terminal for the DC voltage that is normally sourced from said solar panel and said storage battery;

wherein said sensor/trigger circuit further comprises:

said limit switch sub-circuit comprising a series connection of said system switch in series with one or more normally open SPST limit switches each associated with one said one or more low power submerging actuators wherein said limit switches close when their associated said submerging actuators have reached their bottom floor limit in the swimming pool, said series connection of limit switches providing power to said sensor sub-circuit, said triggering sub-circuit, and a ready status indicator which signifies the arming of said safety rescue floor to rise in response to actions of said sensor sub-circuit and said triggering sub-circuit;

said sensor of said sensor sub-circuit incorporating a floating momentary contact SPST tilt switch detecting ripples on the water surface, thereby denoting a person or other substantial entity entering the water;

said sensor sub-circuit further comprising said one or more momentary manual emergency SPST switches being wired in parallel with said floating SPST tilt switch, with a relay used to latch the intermittent signal from said parallel arrangement of said sensor and said manual emergency switches into a solid activation signal via feedback contacts; and, wherein further a main relay contact of said latching relay drives said triggering sub-circuit comprising a parallel connection of one or more triggering devices, each one associated with one of said at least one or more submerging actuators whereby said triggering devices release each said submerging actuator from restraining said buoyant rescue floor, thereby permitting said buoyant safety rescue floor to rise.

2. The electrical subsystem for the swimming pool having the permanently buoyant safety rescue floor, releasable by said triggering sub-circuit, initiated by activation said sensor sub-circuit, as in claim 1, the electrical sub-system further comprising:

said at least one submerging actuator being a low power unidirectional winch actuator;

a power unit incorporating a speed-reducing gear train powering said at least one low power uni-directional winch actuator submerging the buoyant safety rescue floor downward to the pool bottom prior to use;

said at least one low power uni-directional winch actuator incorporating an electrically disengagable clutch between a cable winding drum and said power unit;

said at least one low power uni-directional winch actuator holding said buoyant floor to a position at the bottom of the pool, wherein, upon trigger activation disengaging said clutch, said low power uni-directional winch actuator is disengaged from said power unit to permit said buoyant safety rescue floor to rise freely in an emergency after said sensor sub-circuit is activated signifying the possible presence of a person in danger in the pool.

3. The electrical subsystem for the swimming pool having the permanently buoyant safety rescue floor, releasable by said triggering sub-circuit, initiated by activation of said sensor sub-circuit, as in claim 2 wherein each said low power uni-directional winch actuator includes a gear motor coupled to the electrically disengageable clutch attached to the cable drum, said cable drum being releasable during an emergency to de-couple from said gear motor and to turn freely while said buoyant safety rescue floor rises.

4. The electrical subsystem for the swimming pool having the permanently buoyant safety rescue floor, releasable by said triggering sub-circuit, initiated by activation of said sensor sub-circuit, as in claim 2 wherein a power source of said power unit is an electrical motor.

5. The electrical subsystem for the swimming pool having the permanently buoyant safety rescue floor, releasable by said triggering sub-circuit, initiated by activation of said sensor sub-circuit, as in claim 4 wherein said power unit is a uni-directional AC induction motor used to provide slow submersion of said buoyant safety rescue floor wherein said at least one low power uni-directional winch actuator is used even though said submerged buoyant safety rescue floor stores significant potential energy for rapid release upon triggering by said trigger.

6. The electrical subsystem for the swimming pool having the permanently buoyant safety rescue floor, releasable by said triggering sub-circuit, initiated by activation of said sensor sub-circuit, as in claim 2 wherein said at least one low power uni-directional winch actuator is a plurality of winches dispersed around a periphery of the swimming pool, wherein each said respective clutch of each said respective winch of said plurality of winches is simultaneously electrically disengaged.

7. The electrical subsystem for the swimming pool having the permanently buoyant safety rescue floor, releasable by said triggering sub-circuit, initiated by activation of said sensor sub-circuit, as in claim 6 wherein until each respective clutch is disengaged, a cable is under tension holding said buoyant safety rescue floor down through a direction reversing pulley near a pool bottom.

8. The electrical subsystem for the swimming pool having the permanently buoyant safety rescue floor, releasable by said triggering sub-circuit, initiated by activation of said sensor sub-circuit, as in claim 7 wherein gear friction associated with said power unit prevents backwinding by floor tension.

9. The electrical subsystem for the swimming pool having the permanently buoyant safety rescue floor, releasable by said triggering sub-circuit, initiated by activation of said sensor sub-circuit, as in claim 2 wherein said speed-reducing gear train is a worm gear drive and associated gear friction prevents back winding by floor tension.

10. The electrical subsystem for the swimming pool having the permanently buoyant safety rescue floor, releasable by said triggering sub-circuit, initiated by activation of said sensor sub-circuit, as in claim 2 wherein for a small pool, said power unit is a hand crank cranking said at least one low power uni-directional winch actuator, said at least one low power uni-directional winch actuator being a single hand cranked winch with the electrically disengageable clutch usable for deploying said buoyant safety rescue floor downward to a pool bottom with a centrally attached cable.

11. The electrical subsystem for the swimming pool having the permanently buoyant safety rescue floor, releasable by said triggering sub-circuit, initiated by activation of said sensor sub-circuit, as in claim 10 wherein a down tube encloses said cable, isolating said cable from contact with swimmers.

12. The electrical subsystem for the swimming pool having the permanently buoyant safety rescue floor, releasable by said triggering sub-circuit, initiated by activation of said sensor sub-circuit, as in claim 10 wherein said hand cranked winch includes a worm gear coupled to the electrically disengageable clutch attached to the cable drum, said cable drum being releasable during an emergency to de-couple and turn freely while the buoyant floor rises.

13. The electrical sub-system for a swimming pool having the permanently buoyant safety rescue floor, releasable by said triggering sub-circuit, initiated by activation of said sensor sub-circuit, as in claim 2 wherein said at least one low power uni-directional winch actuator is a compact pod attached to an inside top edge pool edge above the water line of the swimming pool.

14. The electrical subsystem for the swimming pool having the permanently buoyant safety rescue floor, releasable by said triggering sub-circuit, initiated by activation of said sensor sub-circuit, as in claim 13 wherein a bottom pulley is attached to a down tube.

15. The electrical subsystem for the swimming pool having the permanently buoyant safety rescue floor, releasable by said triggering sub-circuit, initiated by activation of said sensor sub-circuit, as in claim 14 wherein said pulley is attached to a pool bottom of the swimming pool.

16. The electrical subsystem for the swimming pool having the permanently buoyant safety rescue floor, releasable by said triggering sub-circuit, initiated by activation of said sensor sub-circuit, as in claim 14 wherein said pulley is attached to a vertical wall near the pool bottom of the swimming pool.

17. The electrical subsystem for the swimming pool having the permanently buoyant safety rescue floor, releasable by said triggering sub-circuit, initiated by activation of said sensor sub-circuit, as in claim 14 wherein a cable loops around said pulley for 180 degrees thereby reversing its direction and attaches to a bracket attached to the buoyant safety rescue floor.

18. The electrical subsystem for the swimming pool having the permanently buoyant safety rescue floor, releasable by said triggering sub-circuit, initiated by activation of said sensor sub-circuit, as in claim claim 1, wherein said one or more submersible actuators is a plurality of actuators.

* * * * *